US011378896B2

(12) United States Patent
Mori

(10) Patent No.: US 11,378,896 B2
(45) Date of Patent: Jul. 5, 2022

(54) IMAGE FORMING APPARATUS AND METHOD OF CONTROLLING IMAGE FORMING APPARATUS

(71) Applicant: BROTHER KOGYO KABUSHIKI KAISHA, Nagoya (JP)

(72) Inventor: Takato Mori, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/208,320

(22) Filed: Mar. 22, 2021

(65) Prior Publication Data

US 2021/0302861 A1 Sep. 30, 2021

(30) Foreign Application Priority Data

Mar. 30, 2020 (JP) ..... JP2020-059319

(51) Int. Cl.
*G03G 15/043* (2006.01)
*G03G 15/04* (2006.01)
*G03G 15/00* (2006.01)

(52) U.S. Cl.
CPC ..... *G03G 15/043* (2013.01); *G03G 15/04036* (2013.01); *G03G 15/50* (2013.01); *G03G 15/6558* (2013.01)

(58) Field of Classification Search
CPC ..... G03G 15/04036; G03G 15/04072; G03G 15/043; G03G 15/50; G03G 15/6529; G03G 15/6558
See application file for complete search history.

(56) References Cited

U.S. PATENT DOCUMENTS

2013/0010045 A1* 1/2013 Hamada ..... G03G 15/04036 347/118
2020/0033782 A1* 1/2020 Sugai ..... G03G 15/5029

FOREIGN PATENT DOCUMENTS

JP 5-254175 A 10/1993
JP 2000-330447 A 11/2000
JP 2018-081221 A 5/2018

* cited by examiner

*Primary Examiner* — Carla J Therrien
(74) *Attorney, Agent, or Firm* — Merchant & Gould P.C.

(57) ABSTRACT

According to aspects of the present disclosures, a controller of an image forming apparatus is configured to determine, when printing is started, whether a particular condition is satisfied, the particular condition being satisfied when an elapsed time from a time when the polygon mirror starts rotating to a time when a rotation speed of the polygon mirror has reached a determination speed which is slower than a target speed is less than an upper limit time, when the particular condition is determined to be satisfied, feed the sheet from the sheet tray with the feed roller before the rotation speed reaches the target speed, and when the particular condition is determined not to be satisfied, feed the sheet from the sheet tray with the feed roller after the rotation speed has reached the target speed.

11 Claims, 7 Drawing Sheets

IMAGE FORMING APPARATUS AND METHOD OF CONTROLLING IMAGE FORMING APPARATUS

CROSS-REFERENCE TO RELATED APPLICATIONS

This application claims priority under 35 U.S.C. § 119 from Japanese Patent Application No. 2020-059319 filed on Mar. 30, 2020. The entire subject matter of the application is incorporated herein by reference.

BACKGROUND

Technical Field

The present disclosures relate to a technique of forming an image on a sheet by transferring a developed image on a photoconductor to the sheet.

Related Art

There has been known an image forming apparatus capable of reducing the time required from starting a printing to ejecting a sheet. Concretely, the image forming apparatus is typically configured to monitor variation of a rotational speed of a polygon mirror at the beginning of printing, and changes a conveying speed of the sheet according to a monitoring result of the rotational speed of the polygon mirror.

SUMMARY

A configuration to change the conveying speed of the sheet by a controller, for example, to change the rotation speed of conveying rollers, may result in a complexity of a sheet conveying mechanism and control processes therefor.

According to aspects of the present disclosure, there is provided an image forming apparatus, comprising a photoconductor, an exposure device including a polygon mirror configured to deflect a light beam to expose the photoconductor, a developing device configured to supply a toner to the photoconductor exposed by the light beam deflected by the polygon mirror, a transfer device configured to transfer the toner on the photoconductor onto a sheet, a sheet tray configured to accommodate multiple sheets, a feed roller configured to feed the sheets accommodated in the sheet tray, and a controller. The controller is configured to determine, when printing is started, whether a particular condition is satisfied, the particular condition being satisfied when an elapsed time from a time when the polygon mirror starts rotating to a time when a rotation speed of the polygon mirror has reached a determination speed which is slower than a target speed is less than an upper limit time, when the particular condition is determined to be satisfied, feed the sheet from the sheet tray with the feed roller before the rotation speed reaches the target speed, and when the particular condition is determined not to be satisfied, feed the sheet from the sheet tray with the feed roller after the rotation speed has reached the target speed.

According to aspects of the present disclosure, there is provided a method of controlling an image forming apparatus equipped with a photoconductor, an exposure device including a polygon mirror configured to deflect a light beam to expose the photoconductor, a developing device configured to supply a toner to the photoconductor exposed by the light beam deflected by the polygon mirror, a transfer device configured to transfer the toner on the photoconductor onto a sheet, and a sheet tray configured to accommodate multiple sheets. The method comprises when printing is started and when an elapsed time from a time when the polygon mirror starts rotating to a time when a rotation speed of the polygon mirror has reached a determination speed which is slower than a target speed is less than a first time, feeding the sheet from the sheet tray before the rotation speed reaches the target speed, and when the elapsed time is equal to or greater than the first time, feeding the sheet from the sheet tray after the rotation speed has reached the target speed.

According to aspects of the present disclosure, there is provided an image forming apparatus, comprising a photoconductor, an exposure device including a polygon mirror configured to deflect a light beam to expose the photoconductor, a developing device configured to supply a toner to the photoconductor exposed by the light beam deflected by the polygon mirror, a transfer device configured to transfer the toner on the photoconductor onto a sheet, a sheet tray configured to accommodate multiple sheets, a feed roller configured to feed the sheets accommodated in the sheet tray, and a controller. When start printing, the controller is configured to start rotating the polygon mirror, when a rotation speed of the polygon mirror reaches a determination speed, that is slower than a target speed, within an upper limit time after the polygon mirror starts rotating, start feeding the sheet from the sheet tray with the feed roller before the rotation speed reaches the target speed, and when the rotation speed does not reach the determination speed within the upper limit time after the polygon mirror starts rotating, start feeding the sheet from the sheet tray with the feed roller after the rotation speed reaches the target speed.

DETAILED DESCRIPTION OF THE EMBODIMENTS

First Embodiment

Figure 1:
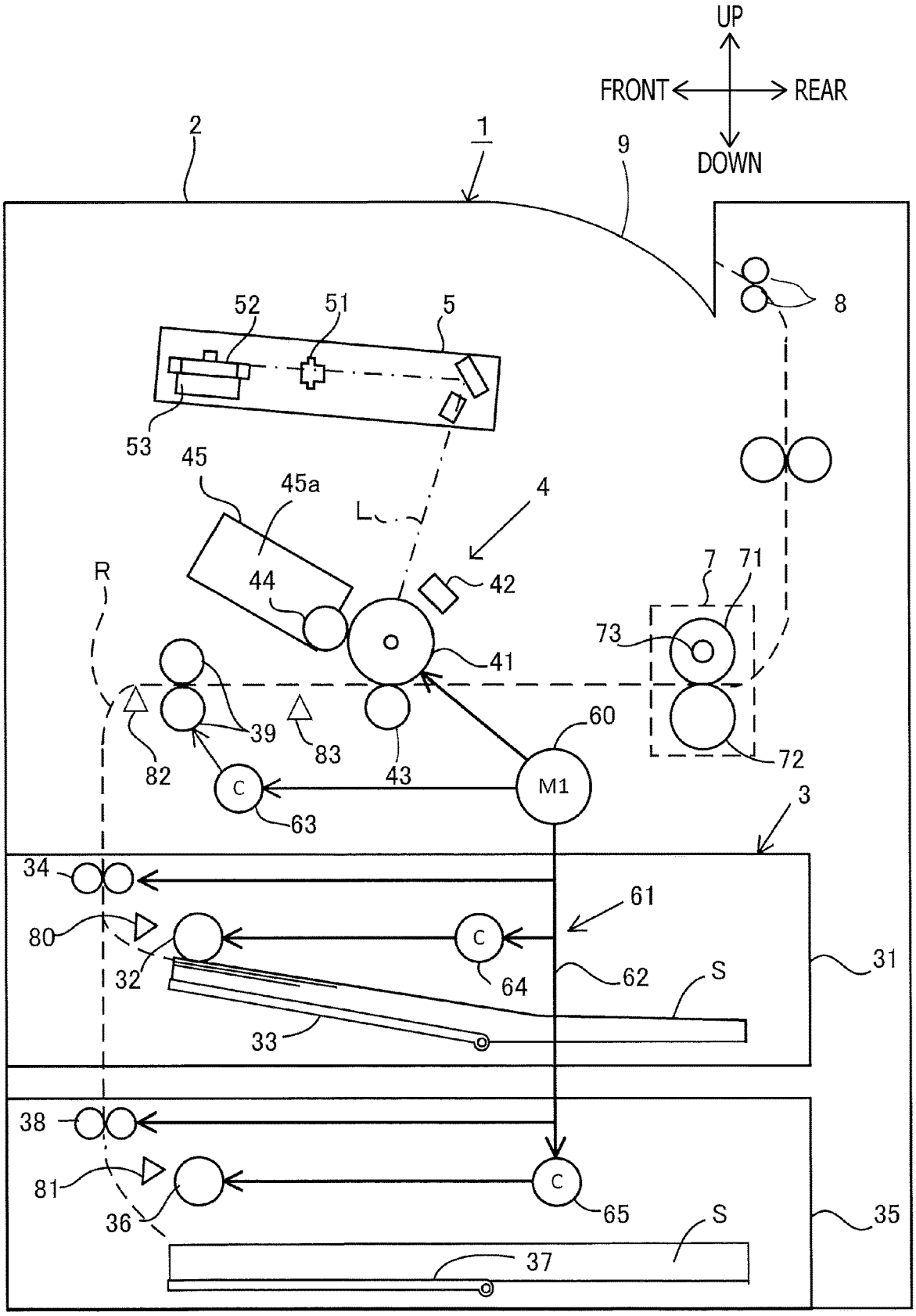
FIG. 1 is a side view schematically illustrating an internal configuration of a printer.

An image forming apparatus according to a first embodiment will be described using a printer 1 as an example. The printer according to the present embodiment is a laser printer that is configured to form a toner image on a recording sheet, an OHP sheet, or the like. In this embodiment, the printer is configured to form a monochromatic toner image on a recording sheet. In the following description, directions are described as indicated in FIG. 1. That is, a left-hand side of FIG. 1 is a front side of the printer 1, a right-hand side of FIG. 1 is a rear side of the printer 1, an upper side and a lower side in FIG. 1 are an upside and a downside of the printer 1, respectively.

Figure 2:
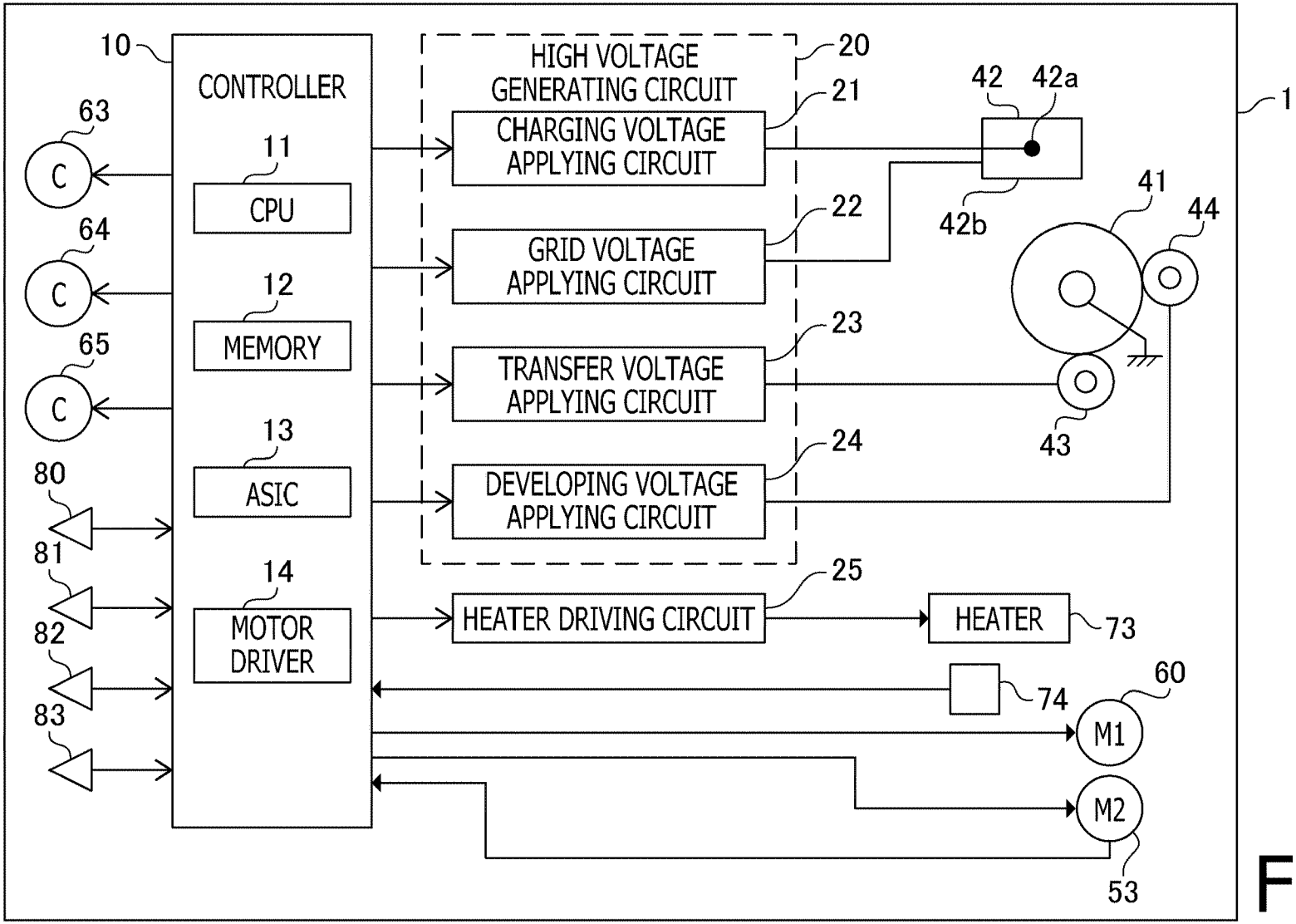
FIG. 2 is a block diagram showing an electrical configuration of the printer.

As shown in FIGS. 1 and 2, the printer 1 has a sheet feeding section 3, a process section 4, an exposure section 5, a fixing device 7, an ejection roller pair 8, a controller 10, a high voltage generation circuit 20, a registration roller pair 39, a main motor 60, a power transmission mechanism 61, and a housing 2. The housing 2 houses each of the above parts.

The sheet feeding section 3 feeds the sheet S. The sheet feeding section 3 has a first tray 31, a second tray 35, a first feed roller 32, a second feed roller 36, a sheet pressing plates 33, 37, and a conveying roller pair 34, and a conveying roller pair 38. The first tray 31 and the second tray 35 are sheet trays, each of which is configured to hold the sheets S. The first and second feed rollers 32, 36 are feed rollers configured to feed the sheets S accommodated in the first and second trays 31 and 35, respectively. When the sheet S in the first tray 31 is subject to feeding, the sheet S on the first tray 31 is brought to contact with the first feed roller 32 by the sheet pressing plate 33 and fed toward the conveying roller pair 34 in conjunction with the rotation of the first feed roller 32. The conveyor roller pair 34 feeds the sheet S toward a registration roller pair 39. If the sheet S in the second tray 35 is to be fed out, the sheet S accommodated in the second tray 35 is brought to contact with the second feed roller 36 by the sheet pressing plate 37 and fed toward the conveying roller pair 38 in conjunction with the rotation of the second feed roller 36. The conveyor roller pair 38 feeds the sheet S toward the registration roller pair 39. After aligning a leading end of the sheet S, the registration roller pair 39 conveys the sheet S toward the process section 4.

A passage of the sheet S, in the housing 2, from each of sheet trays 31 and 35 to a sheet ejection tray 9 is referred to as a conveying passage. Regarding the first tray 31, a distance of the passage of the sheet S from the first feed roller 32 to a conveying position of the process section 4 is a first distance L1. Regarding the second tray 35, a distance of the passage of the sheet S from the second feed roller 36 to the conveying position of the process section 4 is a second distance L2, which is longer than the first distance L1. It is noted that the conveying position is the position, in the conveying passage of the sheet S, between a photoconductor 41 and a transfer section 43, which will be described below.

The exposure section 5 is equipped with a laser light source (not shown), a polygon mirror 52, a scanning lens 51, and a reflector. According to the embodiment, the polygon mirror 52 is a rotatable polygonal mirror with six reflective surfaces on sides of a regular hexagonal prism. The polygon mirror 52 is driven by a polygon motor 53 to rotate about a rotation axis. The exposure section 5 is configured such that a laser beam L, which is emitted by the laser light source, is deflected by the rotating polygon mirror 52, thereby the laser beam L scanning and exposing a surface of the photoconductor 41 of the process section 4. That is, the exposure section 5 exposes the photoconductor 41 by the light deflected by the polygon mirror 52. As a result, an electrostatic latent image is formed on the photoconductor 41. It is noted that the polygon motor 53 is a brushless DC motor.

The process section 4 forms the toner image on the conveyed sheet S. The process section 4 is arranged below the exposure section 5 in the housing 2. The process section 4 is equipped with a photoconductor 41, a charger 42, the transfer section 43, and a developing device 45. The photoconductor 41 is a cylindrical photoconductive drum. The transfer section 43 includes a transfer roller configured to sandwich the sheet S between the transfer roller (i.e., the transfer section 43) and the photoconductor 41. The developing device 45 has a developing roller 44 and a toner container 45*a*.

The charger 42 is a scorotron-type charger having a charging wire 42*a* and a grid section 42*b*. A charging voltage is applied to the charging wire 42*a* and a grid voltage is applied to the grid section 42*b* by the high voltage generating circuit 20 (FIG. 2), thereby a corona discharge occurs and the surface of the photoconductor 41 is uniformly charged.

In the process section 4, after the surface of the photoconductor 41 is uniformly charged by the charger 42, the surface of the photoconductor 41 is exposed to the laser beam emitted by the exposer section 5, thereby an electrostatic latent image based on image data being formed on the photoconductor 41. The developing roller 44 supplies the toner in the toner container 45*a* to the photoconductor 41 on which the electrostatic latent image is formed. This causes the electrostatic latent image to become a visible image (i.e., developed) and the toner image is formed on the photoconductor 41. Thereafter, the sheet S supplied from the sheet feeding section 3 is conveyed to the transfer position between the photoconductor 41 and the transfer section 43, and the toner image formed on the photoconductor 41 is transferred onto the sheet S.

The sheet S onto which the toner image is transferred is conveyed by the photoconductor 41 and the transfer section 43 to the fixing device 7. The fixing device 7 heat-fixes the toner image on the sheet S conveyed from the process section 4. In this embodiment, the fixing device 7 has a heating roller 71 for heating the sheet S and a pressure roller 72 for sandwiching the sheet S between the pressure roller 72 itself and the heating roller 71. A heater 73 is arranged in the heating roller 71 to raise the temperature of the heating roller 71. The heater 73 is, for example, a halogen lamp. In the fixing device 7, the sheet S on which the toner image is transferred is conveyed between the heating roller 71 and the pressure roller 72, thereby the toner image being heat-fixed on the sheet S. The sheet S, to which the toner image is heat-fixed, is ejected by the ejection rollers 8 onto the ejection tray 9.

The main motor 60 is a drive source for driving each roller. A drive power of the main motor 60 is transmitted to the feed rollers 32, 36, the conveyor roller pairs 34, 38, and the photoconductor 41 via a power transmission mechanism 61. In this embodiment, the main motor 60 is a brushless DC motor.

The power transmission mechanism 61 has a transmission section 62, a first clutch 63, a second clutch 64, and a third clutch 65. The transmission section 62 includes a plurality of gears and is configured to transmit the drive power of the main motor 60 to each of the feed rollers 32, 36, the registration roller pair 39, and the photoconductor 41. The first, second and third clutches 63, 64 and 65 are controlled by the controller 10 to switch between a transmission state in which the power of the main motor 60 is transmitted to each of the feed rollers 32 and 36, and the registration roller pair 39 and a blocked state in which the transmission of the power to each of the feed rollers 32 and 36, and the registration roller pair 39 is blocked. In this embodiment, the first to third clutches 63, 64, 65 are electromagnetic clutches, each of which can be switched between an ON state and an OFF state in response to a control signal output from the controller 10. The first to third clutches 63, 64, 65 are examples of a switching mechanism.

The first clutch 63 is connected to a portion of the transmission section 62 that transmits the power of the main motor 60 to the registration roller pair 39. When the first clutch 63 is in the ON state, the first clutch 63 is in the transmission state in which the power of the main motor 60 is transmitted to the registration roller pair 39, while when the first clutch 63 is in the OFF state, the first clutch 63 is in the blocked state in which the power of the main motor 60 is transmitted to the registration roller pair 39.

The second clutch 64 is connected to a portion of the transmission section 62 that transmits the power of the main motor 60 to the first feed roller 32. When the second clutch 64 is in the ON state, the second clutch 64 is in the transmission state in which the power of the main motor 60 is transmitted to the first feed roller 32, while when the second clutch 64 is in the OFF state, the second clutch 64 is in the blocked state in which the power of the main motor 60 is transmitted to the first feed roller 32.

The third clutch 65 is connected to a portion of the transmission section 62 that transmits the power of the main motor 60 to the second feed roller 36. When the third clutch 65 is in the ON state, the third clutch 65 is in the transmission state in which the power of the main motor 60 is transmitted to the second feed roller 36, while when the third clutch is in the OFF state, the third clutch 65 is in the blocked state in which the power of the main motor 60 is transmitted to the second feed roller 36.

In the conveying passage, a first sheet sensor 80 is disposed between the first feed roller 32 and the conveying roller pair 34 to detect the sheet S fed out from the first tray 31. The first sheet sensor 80 outputs a detection signal SE1 in a High state when detecting the sheet S, and outputs the detection signal SE1 in a Low state when the first sheet sensor 80 does not detect the sheet S. In the conveying passage, a second sheet sensor 81 is disposed between the second feed roller 36 and the conveying roller pair 38 to detect the sheet S fed out from the second tray 35. The second sheet sensor 81 outputs a detection signal SE2 in a High state when detecting the sheet S, and outputs the detection signal SE2 in a Low state when the second sheet sensor 81 does not detect the sheet. In the conveying passage, a third sheet sensor 82 is arranged between the conveying roller pair 34 and the registration roller pair 39 to detect the sheet S between the conveying roller pair 34 and the registration roller pair 39. The third sheet sensor 82 outputs a detection signal SE3 in a High state when detecting the sheet S, and outputs the detection signal SE3 in a Low state when third sheet sensor 82 does not detect the sheet S. In the conveying passage, a fourth sheet sensor 83 is arranged between the registration roller pair 39 and the photoconductor 41 to detect the sheet S between the registration roller pair 39 and the photoconductor 41. The fourth sheet sensor 83 outputs detection signal SE4 in a High state when detecting the sheet S, and outputs the detection signal SE4 in a Low state when the fourth sheet sensor 83 does not detect the sheet S.

Next, an electrical configuration of the printer 1 will be described. The controller 10 shown in FIG. 2 is connected to the high voltage generation circuit 20, the main motor 60, the polygon motor 53, the first to third clutches 63, 64, 65, a fixing temperature sensor 74, and the seat sensors 80, 81, 82, and 83.

The controller 10 has a CPU 11, a memory 12, an ASIC 13, and a motor driver 14. The CPU 11 and the ASIC 13 perform a printing process by controlling each part of the printer 1. The memory 12 stores programs referred to by the CPU 11, as well as various setting values related to voltage and time. The motor driver 14 outputs drive signals for the main motor 60 and the polygon motor 53 to rotate. The motor driver 14 also functions as a speed detector to detect the rotation speed R [rpm] of the polygon motor 53.

The high voltage generation circuit 20 is configured to generate voltages to be supplied to respective parts of the printer 1 under control of the controller 10. In FIG. 2, the high voltage generation circuit 20 includes a charging voltage applying circuit 21, a grid voltage applying circuit 22, a transfer voltage applying circuit 23, and a development voltage applying circuit 24. The charging voltage applying circuit 21 is a circuit configured to generate a charging voltage and is connected to the charging wire 42*a* of the charger 42. The grid voltage applying circuit 22 is a circuit configured to generate a grid voltage and is connected to a grid section 42*b* of the charger 42. The transfer voltage applying circuit 23 is a circuit configured to generate a transfer voltage and is connected to the transfer section 43. The developing voltage applying circuit 24 is a circuit configured to generate a developing voltage and is connected to the developing roller 44.

A heater drive circuit 25 is configured to drive the heater 73 by controlling an AC power supplied from an AC power source (not shown). Concretely, the controller 10 performs a feedback control in which a control signal output to the heater drive circuit 25 is used as an operation amount such that a temperature detection signal D1, which is detected by the fixing temperature sensor 74 and indicates a temperature of the heating roller 71, approaches a target value corresponding to a target temperature of the heating roller 71. The heater drive circuit 25 changes an energizing period in response to the operation signal from the controller 10, thereby controlling the AC power supplied to the heater 73.

In the printer 1 having the above configuration, the controller 10 causes the exposure section 5 to start exposing when a rotation speed R of the polygon mirror 52 detected by the motor driver 14 rises to a target speed Rt when the printing is started. It is noted that, if the feeding of the sheet S by the feed rollers 32, 36 is started after the rotation speed R of the polygon mirror 52 reaches the target speed Rt, there is a concern that a time required from the start of rotation of the polygon mirror 52 to the start of the exposure by the exposure section 5 will be long. Therefore, in this embodiment, the controller 10 is configured to change a timing of feeding the sheet S according to the acceleration of the polygon mirror 52 when the rotation speed of the polygon mirror 52 increases.

Figure 3:
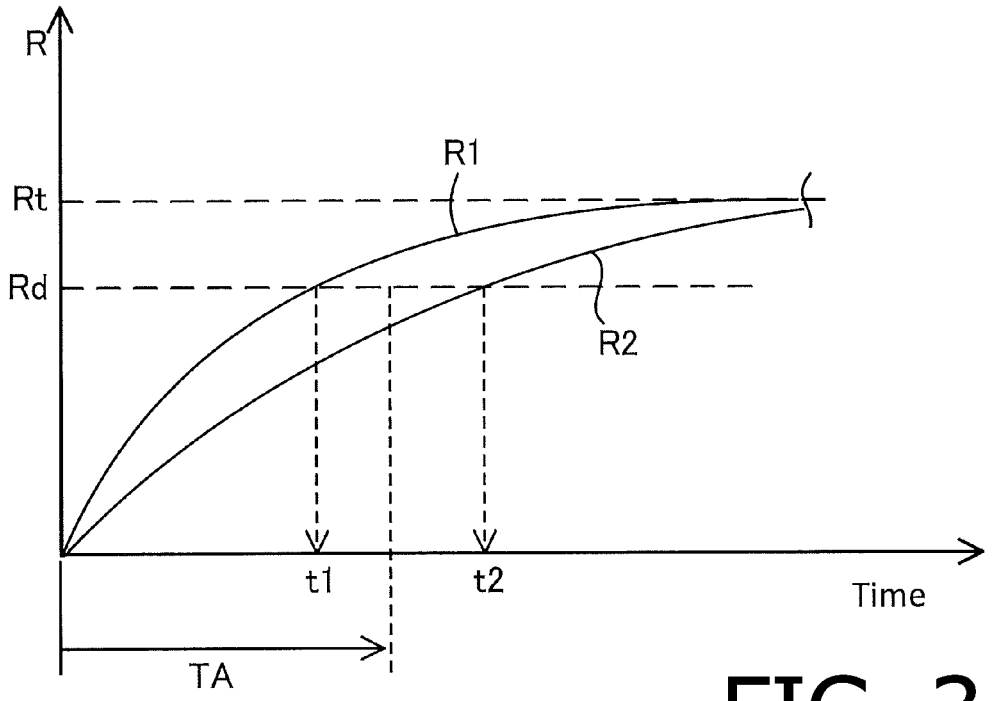
FIGS. 3 and 4 show transition of a rotation speed of a polygon motor.

FIG. 3 shows transitions of the rotation speeds of the polygon mirror 52 after starting the rotation of the polygon mirror 52 until the rotation speed of the polygon mirror 52 reaches the target speed Rt when the rotation speed changes with a curve R1 and with a curve R2, where the rotational acceleration is lower than the case of the curve R1. In this embodiment, it is determined whether the elapsed time T1 from the start of rotation of the polygon mirror 52 until the rotation speed R reaches a determination speed Rd, which is lower than the target speed Rt, satisfies a particular condition where the elapsed time T1 is less than a upper limit time TA. This is because the greater the rotational acceleration, the less time it takes for the rotation speed R of the polygon mirror 52 to increase to the target speed Rt.

The upper limit time TA is the upper limit time in the particular condition where the rotation speed of the polygon mirror 52 reaches the target speed Rt at the timing when the exposure by the exposure section 5 starts, even if the sheet S is fed out by the feed rollers 32, 36 before the polygon mirror 52 reaches the target speed Rt. The elapsed time T1 is a time from the start of rotation of the polygon mirror 52 until the rotation speed R reaches the determination speed Rd. In this embodiment, the elapsed time T1 is counted by the CPU 11 based on the rotation speed R of the polygon motor 53, which is detected by the motor driver 14. The rotation speed R of the polygon mirror 52 changes, for example, depending on change of the viscosity of a lubricating oil in a bearing of the polygon motor 53 in accordance with the environmental temperature.

In the example shown in FIG. 3, when the rotation speed of the polygon mirror 52 changes in accordance with the curve R1, the rotation speed R reaches the determination speed Rd (time t1) before the upper limit time TA elapses. That is, if the rotation speed of the polygon mirror 52 changes in accordance with the curve R1, the elapsed time T1 is less than the upper limit time TA. On the other hand, if the rotation speed of the polygon mirror 52 changes in accordance with the curve R2, the rotation speed R reaches the determination speed Rd (time t2) after the upper limit time TA elapses. In other words, when the rotation speed of the polygon mirror 52 changes in accordance with the curve R2, the elapsed time T1 is greater than or equal to the upper limit time TA.

Figure 4:
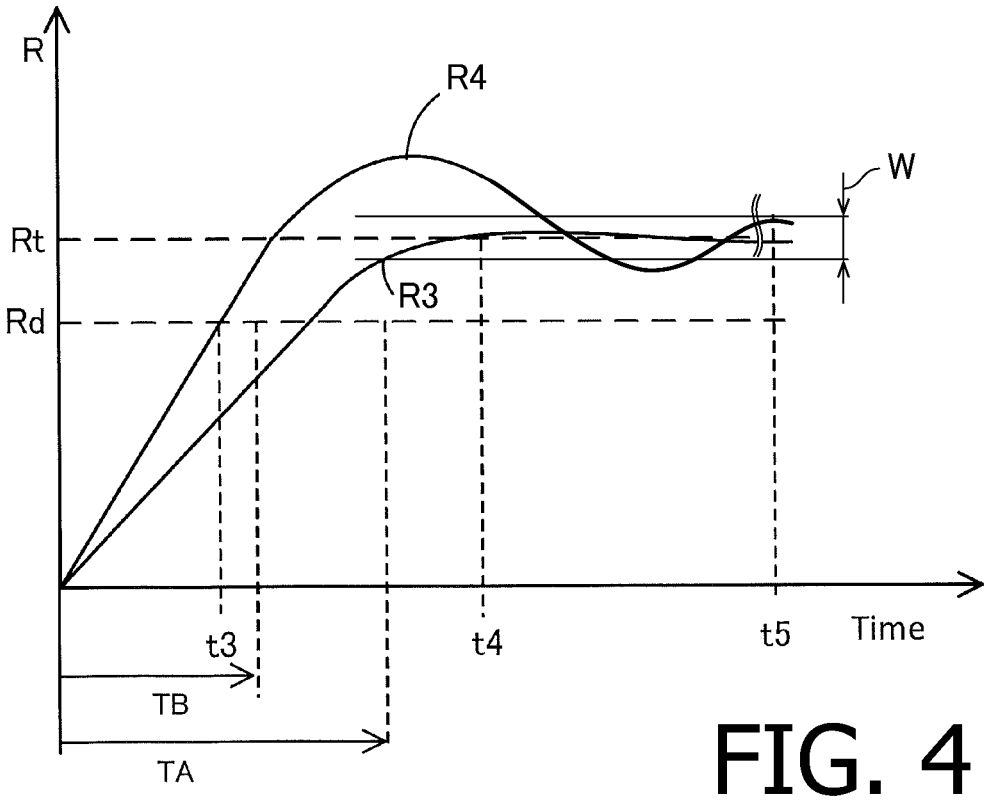

FIG. 4 shows the transition of rotation speeds R after starting rotation of the polygon mirror 52 until the rotation speeds of the polygon mirror 52 reach the target speed Rt, when the rotation speed of the polygon mirror 52 changes in accordance with a curve R3 and a curve R4, where the rotational acceleration for the curve R4 is greater than that for the curve R3. In FIG. 4, if the rotational acceleration is excessively high, it may take time for the rotation speed R to reach the target speed Rt after exceeding the target speed Rt. When the rotation speed of polygon mirror 52 changes in accordance with the curve R4, the rotation speed R rises to the determination speed Rd at an earlier time (time t3) than when the rotation speed changes in accordance with the curve R3. However, when the rotation speed of the polygon mirror 52 changes in accordance with the curve R4, after increasing to the determination speed Rd, the rotation speed repeatedly decreases and increases before converging to the target speed Rt at a later time (time t5) than a time (time t4) at which the target speed Rt converges to the target speed RT when the rotation speed changes in accordance with the curve R3.

Therefore, in this embodiment, the controller 10 determines that the particular condition is satisfied when the time from the start of rotation of the polygon mirror 52 until the rotation speed R reaches the determination speed Rd is less than the upper limit time TA and is equal to or greater than a lower limit time TB, which is shorter than the upper limit time TA. In other words, the controller 10 determines that the particular condition is not satisfied when the rotational acceleration of the polygon mirror 52 when the speed of the polygon mirror 52 increases is excessively large and the elapsed time T1 is less than the lower limit time TB. In the example shown in FIG. 4, when the rotation speed of the polygon mirror 52 changes in accordance with the curve R4, the particular condition is not satisfied because the elapsed time T1 is less than the lower limit of time TB. It is noted that the lower limit time TB is the lower limit of time required for the rotation speed R to reach the determination speed Rd when the polygon mirror 52 rotates at the normal rotational acceleration.

When determining that the particular condition is satisfied, the controller 10 feeds the sheet S out of the first tray 31 or the second trays 35 with the feed roller 32 or 36 before the rotation speed R reaches the target speed Rt. On the other hand, when determining that the particular conditions are not satisfied, the controller 10 feeds the sheet S out of the first tray 31 or the second trays 35 with the feed roller 32 or the second feed roller 36 after the rotation speed R has reached the target speed Rt.

Figure 5:
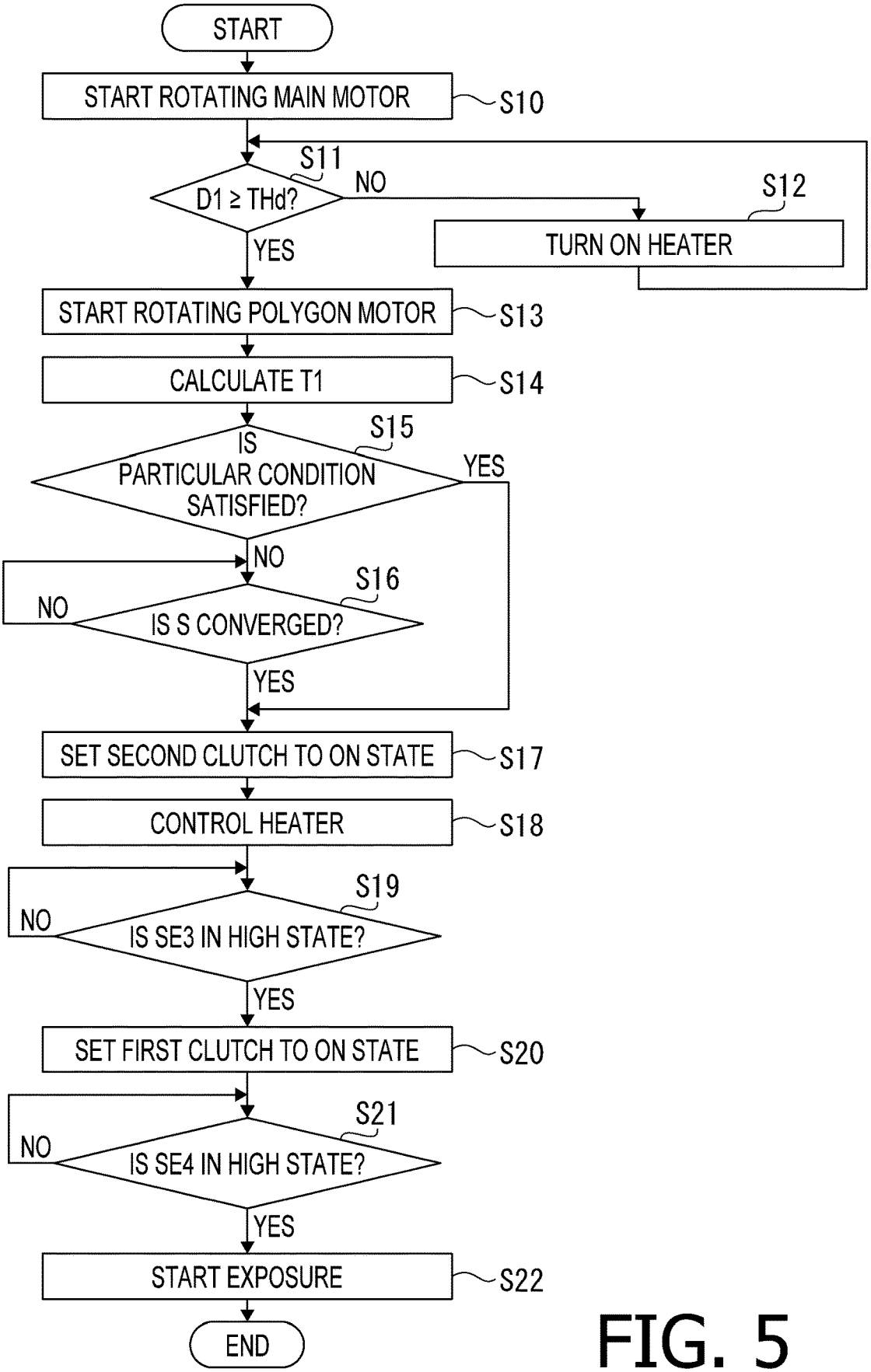
FIG. 5 is a flowchart illustrating a printing process according to a first embodiment.

Next, referring to FIG. 5, the printing process will be described. The process shown in FIG. 5 is performed by the controller 10 in response to the printer 1 receiving a printing command to start the printing process with the sheet S on the first tray 31 designated.

In step S10, the controller 10 starts rotating the main motor 60. At this stage, any of the clutches 63, 64, 65 are in the OFF state.

In S11, the controller 10 determines whether the temperature of the heating roller 71 has reached or exceeded a determination temperature THd based on the temperature detection signal D1 received from the fixing temperature sensor 74. The determination temperature THd is lower than the target temperature of the heating roller 71, and is a temperature at which the heating roller 71 has reached when the sheet S reaches the fixing device 7, even though the control of the heater 73 is started after the sheet S is fed out of the first tray 31. In other words, in a case where the control of the heater is started when the sheet S is fed out from the first tray 31 and when the temperature of the heater 73 is equal to or greater than the determination temperature THd, the temperature of the heater 73 reaches the target temperature when (or before) the sheet S reaches the fixing device 7. When the controller 10 determines that the temperature indicated by the temperature detection signal D1 is less than the determination temperature THd (S11: NO), the controller proceeds to S12 and turns on the heater 73 to start heating the heating rollers 71. Then, the controller 10 returns to S11.

When determining that the temperature indicated by the temperature detection signal D1 is greater than or equal to the determination temperature THd (S11: YES), the controller 10 proceeds to step S13. In step S13, the controller 13 starts rotating the polygon motor 53. Concretely, the controller 10 outputs a drive signal to the polygon motor 53 such that the rotation speed R detected by the motor driver 14 increases to the target speed Rt. Then, the rotation speed R of the polygon motor 53 increases.

In S14, the controller 10 calculates the elapsed time T1 required for the rotation speed R to reach the determination speed Rd. Concretely, the controller 10 counts the time until the rotation speed R detected by the motor driver 14 reaches the determination speed Rd, and defines the counted value as the elapsed time T1. For example, when the target speed is 31000 [rpm], the determination speed Rd may be set to 2000 [rpm].

In S15, the controller 10 determines whether the particular condition is satisfied or not based on the elapsed time T1 calculated in S14. Concretely, the controller 10 determines that the particular condition is satisfied when the elapsed time T1 is less than the upper limit time TA and equal to or greater than the lower limit time TB, which is shorter than the upper limit time TA.

When determining that the particular condition is not satisfied (S15: NO), the controller 10 proceeds to S16. In S16, the controller 10 determines whether the rotation speed R converges within a speed range W. It is noted that the speed range W is a determination range of the rotation speed R when the rotation speed R is determined to have converged to the target speed Rt, the speed range W being a range having a particular speed range with respect to the target speed Rt. For example, if a local maximum value of the fluctuating rotation speed R is smaller than a upper limit value of the speed range W, or a local minimum value is larger than a lower limit value of the speed range W, it may be determined that the rotation speed R has converged to the speed range W.

When the controller 10 determines that the particular condition is satisfied (S15: YES), the controller 10 proceed to S17. In S17, the controller 10 sets the second clutch 64 to an ON state so that the second clutch 64 is set to the transmission state in which the power of the main motor 60 is transmitted to the first feed roller 32. That is, after starting rotation of the main motor 60, when it is determined that the particular condition is satisfied, the power of the main motor 60 is transmitted to the first feed roller 32. Accordingly, since the rotation of the main motor 60 is already stable at a timing when the feeding of the sheet S is started, the feeding of the sheet S by the first feed roller 32 can be started at an early stage.

In S18, the controller 10 controls the heating of the heating roller 71 by the heater 73 so that the temperature of the heating roller 71 is maintained at the target temperature.

In S19, the controller 10 determines whether or not the leading end of the sheet S has reached the registration roller pair 39 based on the detection signal SE3 received from the third sheet sensor 82. When the detection signal SE3 received from the third sheet sensor 82 is in the Low state, the leading end of the sheet S has not reached the registration roller pair 39, and the controller 10 pauses. When the detection signal SE3 received from the third sheet sensor 82 is in the High state, the controller 10 proceeds to S20. In S20, the controller 10 sets the second clutch 64 to the OFF state and the first clutch 63 to the ON state so that the power of the main motor 60 is in the transmission state where the power of the main motor 60 is transmitted to the registration roller pair 39. Thus, the sheet S is conveyed by the registration roller pair 39 toward the photoconductor 41.

In S21, the controller 10 determines whether the leading end of the sheet S has reached a particular position which is upstream of the photoconductor 41 based on the detection signal SE4 received from the fourth sheet sensor 83. When the detection signal SE4 received from the fourth sheet sensor 83 is in the Low state, the leading end of the sheet S has not reached the photoconductor 41, and the controller 10 pauses. When the detection signal SE4 received from the fourth sheet sensor 83 is in the High state, the controller 10 proceeds to S22. In S22, the controller 10 starts exposing with the exposure section 5. As a result, the toner image is formed on the photoconductor 41 by the exposure section 5. The toner image formed on the photoconductor 41 is transferred onto the sheet S.

Although not shown, the sheet S then passes a nip between the heating roller 71 and the pressure roller 72 of the fixing device 7, thereby the toner image transferred onto the sheet S being fixed to the sheet S. Thus, the printing process for one sheet S is completed.

Figures 6A, 6B, 6C, 6D:
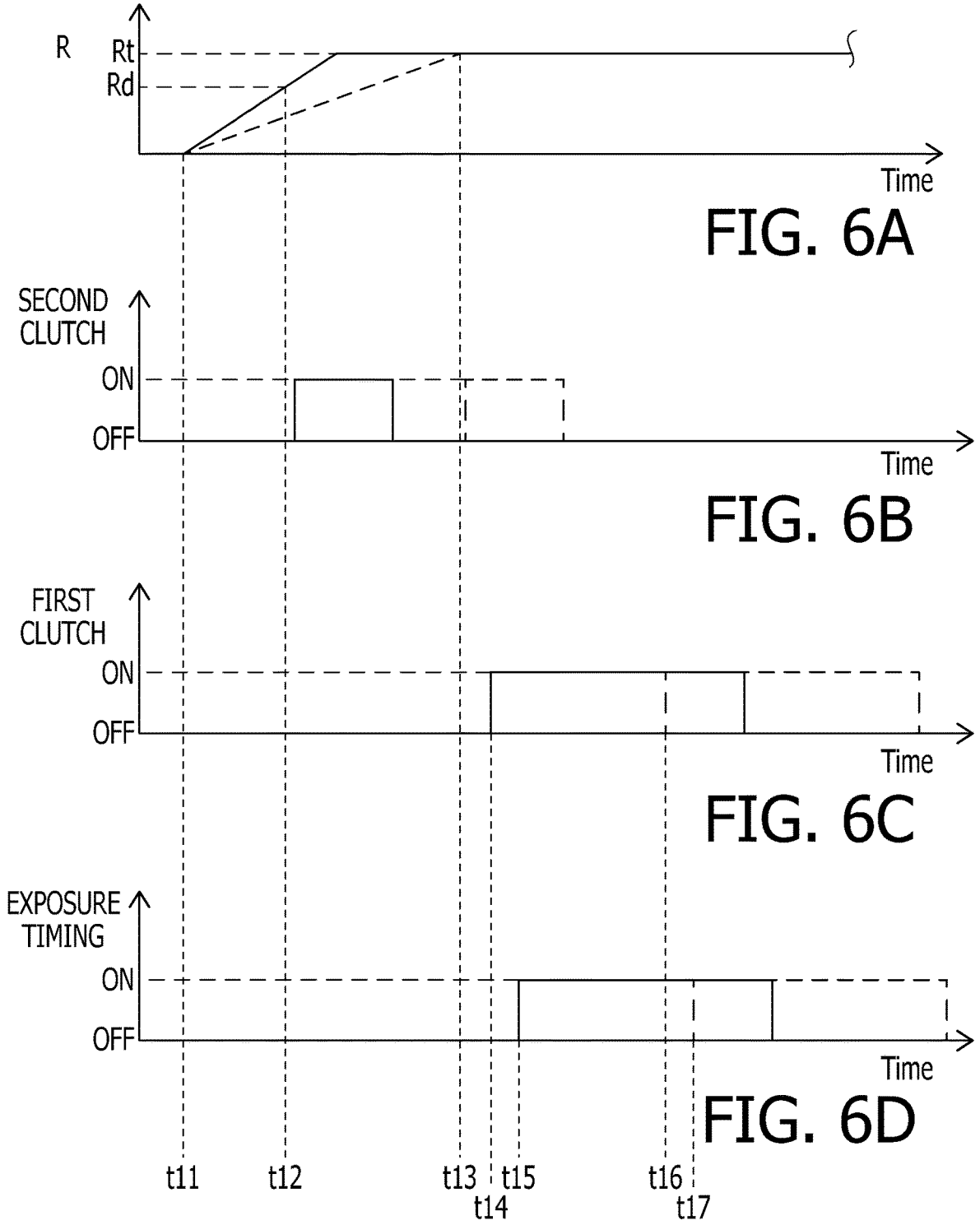
FIGS. 6A-6D show a timing chart of the printing process.

Next, referring to FIGS. 6A-6D, the timing from the start of rotation of the polygon mirror 52 to the start of exposure by the exposure section 5 will be described. FIG. 6A is a timing chart showing the change in the rotation speed R of the polygon mirror 52. FIG. 6B is a timing chart showing the change of the state (i.e., the ON or OFF state) of the second clutch 64. FIG. 6C is a timing chart showing the change of the state (i.e., the ON or OFF state) of the first clutch 63. FIG. 6D is a timing chart showing the exposure timing, wherein the exposure is started when in the ON state, and the exposure is ended when the state is changed from the ON state to the OFF state. In each of FIGS. 6A-6D, the timing when the rotation speed R of the polygon mirror 52 does not satisfy the particular condition is shown by dashed lines.

At time t11, the rotation of the polygon mirror 52 has started (FIG. 6A). At time t12, the rotation speed R at the rise of the polygon mirror 52 has reached the determination speed Rd, and then the state of the second clutch 64 changes from the OFF state to the ON state (FIG. 6B). This causes the first feed roller 32 to rotate by the power of the main motor 60, and the feeding of the sheet S is started. In the present embodiment, the state of the second clutch 64 may be changed from the OFF state to the ON state between the time when the rotation speed R reaches the determination speed Rd and the time when the rotation speed R reaches the target speed Rt.

In time t14, when the leading end of the sheet S passes the third sheet sensor 82, the state of the first clutch 63 is set to the ON state and the conveyance of the sheet S by the registration roller pair 39 is started (FIG. 6C). Thereafter, at time t15, as the leading end of the sheet S passes through the fourth sheet sensor 83, the exposure process by the exposure section 5 is started (FIG. 6D). Thereafter, the sheet S is conveyed to the transfer position by the photoconductor 41 and the transfer section 43, and the toner image formed on the photoconductor 41 is transferred onto the sheet S.

On the other hand, when the rotation speed R does not satisfy the particular condition, the rotation speed R at the rise of the polygon mirror 52 reaches the target speed Rt at time t13, and the state of the second clutch 64 changes from the OFF state to the ON state (FIG. 6B). That is, when the rotation speed R satisfies the particular condition, the timing of sending out the sheet S becomes earlier compared to a case where the particular condition is not satisfied.

At time t16, when the leading end of the sheet S passes the third sheet sensor 82, the state of the first clutch 63 is set to the ON state and the conveyance of the sheet S by the registration roller pair 39 is started (FIG. 6C). Thereafter, at time t17, when the leading end of the sheet S passes the fourth sheet sensor 83, the exposure process by the exposure section 5 is started (FIG. 6D). That is, when the rotation speed R satisfies the particular condition, the timing of the transfer of the toner image onto the sheet S becomes earlier compared to a case where the particular condition is not satisfied.

According to the present embodiment described above, the following effects can be achieved. When the printing is started, the controller 10 determines whether or not the particular condition is satisfied. The particular condition is that the elapsed time from the start of rotation of the polygon mirror 52 until the rotation speed R of the polygon mirror 52 reaches the determination speed Rd, which is lower than the target speed Rt, is less than the upper limit time TA. When determining that the particular condition is satisfied (i.e., the elapsed time is less than the upper limit time TA), the controller 10 causes first feed roller 32 to feed the sheet S from the sheet tray before the rotation speed R reaches the target speed Rt. When determining that the particular condition is not satisfied, the controller 10 causes the first feed roller 32 to feed the sheet S from the sheet tray after the rotation speed R has reached the target speed Rt. According to the above configuration, when the rotational acceleration of the polygon mirror 52 is a value that allows the sheet S to be fed out earlier, the timing of feeding the sheet S is made earlier, thereby the time required to transfer the toner image onto the sheet S can be reduced. As a result, the time required for printing can be reduced.

When the printing is started, the controller 10 determines that the particular condition is satisfied when the elapsed time T1 from the start of rotation of the polygon mirror 52 until the rotation speed R reaches the determination speed Rd is less than the upper limit time TA and equal to or larger than the lower limit time TB. This ensures that the time required for printing can be shortened in a situation where the rotation speed R of the polygon mirror 52 satisfies the particular condition.

When determining that the particular condition is not satisfied, the controller 10 feeds the sheet A out of the sheet tray 31 with the feed roller 32 after the rotation speed R converges within the speed range W of a particular speed width including the target speed Rt. According to the above configuration, printing defects can be prevented because the exposure is prevented from starting while the rotation speed R of the polygon mirror 52 is unstable.

When the printing is started, the controller 10 starts rotating the polygon mirror 52 after stating the main motor 60 to rotate. In the above configuration, when the printing is started, the peak power consumption caused by simultaneously rotating the main motor 60 and the polygon motor 53 can be suppressed.

When starting printing, the controller 10 starts rotating the main motor 60 by setting the state of the second clutch 64 to the blocked state so that the power of the main motor 60 is not transmitted to the first feed roller 32. Thereafter, when it is determined that the particular condition is satisfied, the controller 10 sets the state of the second clutch 64 to the transmission state to start rotating the first feed roller 32. This allows the feeding of the sheet S by the first feeding roller 32 to be started earlier as the rotation speed of the main motor 60 is already stable at the time of starting the feeding of the sheet S.

The fixing device 7 heats the sheet S to which the toner image is transferred, thereby heat-fixing the toner image onto the sheet. When the printing is started, the controller 10 determines whether or not the particular condition is satisfied on the condition that the temperature of the fixing device 7 is greater than or equal to the determination temperature THd. According to the above configuration, the time required for printing can be reduced while suppressing a fixing failure of the toner image transferred to the sheet.

When determining that the particular condition is satisfied, the controller 10 starts energizing the heater 73 after feeding the sheet with the first feed roller 32. According to the above configuration, unnecessary power consumption can be reduced when heating the heating roller 71.

Modification of the First Embodiment

As the particular condition used in S15, a condition where the elapsed time T1 for the rotation speed R to reach the determination speed Rd is less than or equal to the lower limit time TB may not be necessary. In this case, it is determined that the particular condition is satisfied when the elapsed time T1 for the rotation speed R to reach the determination speed Rd is less than the upper limit time TA.

The controller 10 is not limited to determine whether the particular condition is satisfied by using the elapsed time T1 from the start of rotation of the polygon mirror 52 until the rotation speed R rises to a determination speed Rd lower than the target speed Rt. The controller 10 may determine the rotational acceleration of the polygon mirror 52 when the rotation speed is increasing. For example, the controller 10 may calculate the rotational acceleration from the start of rotation of the polygon mirror 52 until the rotation speed reaches the determination speed Rd, and when it is determined, in S15, that the calculated rotational acceleration is higher than a particular determination value, the controller 10 may determine that the particular condition is satisfied.

After starting the rotation of the main motor 60 in S10, the controller 10 may start the rotation of the polygon motor 53 in S13 without judging the temperature of the heating roller 71. In such a case, the process of S11 and S12 can be canceled.

The printer 1 may not be equipped with the second tray 35.

Second Embodiment

In the description of a second embodiment, a configuration differs from that of the first embodiment will be mainly described. In the second embodiment, parts with the same reference numbers/symbols as those in the first embodiment indicate the same parts and descriptions thereof will not be repeated.

In this embodiment, whether the particular condition is satisfied or not is determined when feeding the sheet S from the second tray 35, i.e., when the sheet S travels a longer passage from the second feed roller 36 to the transfer position. Then, in accordance with the determination result, a timing of sending out the sheet S is made earlier. It is because, in the situation where the sheet S is fed out of the second tray 35, i.e., when the longer conveying passage is used, the time required for printing is longer than in a case where the sheet S is fed out of the first tray 31.

Figure 7:
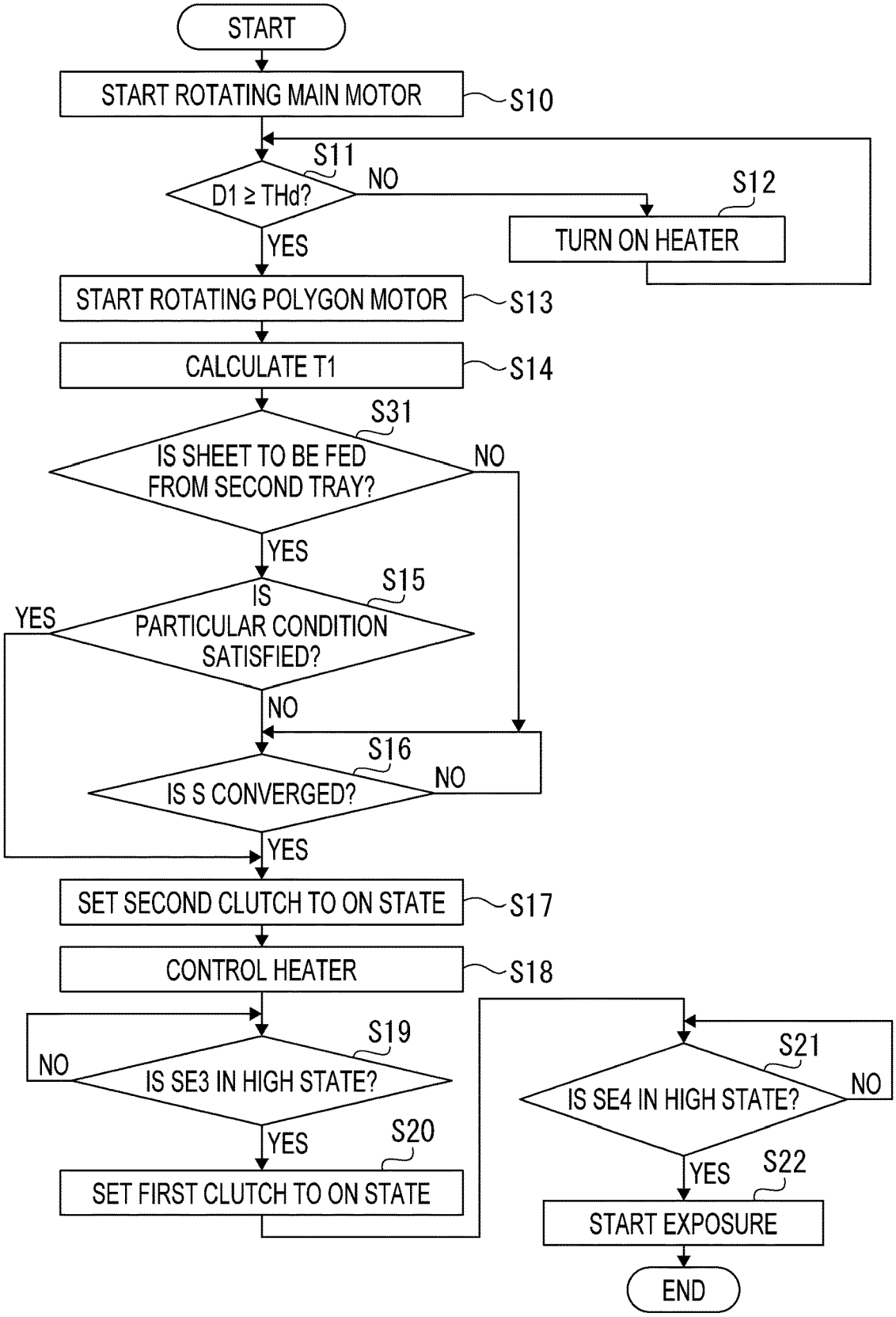
FIG. 7 is a flowchart illustrating a printing process according to a second embodiment.

Referring to FIG. 7, the printing process according to the second embodiment will be described. The printing process shown in FIG. 7 is performed by the controller 10 in response to receipt of a printing command to start the printing process.

The steps S10-S13 are similar to those shown in FIG. 5 (i.e., the first embodiment). In S14, the controller 10 calculates the elapsed time T1 required for the rotation speed R to reach the determination speed Rd. In S31, the controller 10 determines whether or not the sheet S is to be fed from the second tray 35. For example, when the sheet S on the second tray 35 is designated in a print setting included in the print data, the controller 10 makes an affirmative determination in S31 (S13: YES) and proceeds to S15.

In S15, the controller determines whether or not the particular condition is satisfied. When determining that the particular condition is satisfied (S15: YES), the controller 10 proceeds to S17. In S17, the controller 10 sets the state of the second clutch 64 to the ON state so that the power of the main motor 60 is transmitted to the first feed roller 32 (i.e., the transmission state). On the other hand, when it is determined in S31 that the sheets on the first tray 31 are to be fed, the controller 10 proceeds to S16. In S16, the controller 10 determines whether the rotation speed R converges within the speed range W. When the controller 10 determines that the rotation speed R converges within the speed range W, the controller 10 proceeds to S17. In S17, the controller 10 sets the state of the second clutch 64 to the ON state so that the power of the main motor 60 is transmitted to the first feed roller 32 (i.e., the transmission state). According to the above configuration, when the sheet S on the second tray 35 is to be fed and when the particular condition is satisfied, the timing for starting to feed the sheet S becomes earlier compared to a case where the sheet S on the first tray 31 is to be fed. Thereafter, as in the first embodiment, steps S18 to S22 are executed.

According to the second embodiment described above, the following effects can be achieved.

The controller 10 is configured to determine whether or not the particular condition is satisfied, provided that the sheet S is fed out of the second tray 35. According to this configuration, the time required for printing when the sheet S is fed out of the second tray 35 (i.e., when the sheet S is to be conveyed along a longer conveying passage), can be reduced.

Third Embodiment

In the description of a third embodiment, a configuration differs from that of the first embodiment will be mainly described. In the third embodiment, parts with the same reference numbers/symbols as those in the first embodiment indicate the same parts and descriptions thereof will not be repeated.

According to the third embodiment, the fixing device 7M is configured to spray a fixing solution to fix the toner image transferred onto the sheet S. According to the third embodiment, compared to the first embodiment or the second embodiment, the printing process does not require a process of heating the heating roller 71.

Figure 8:
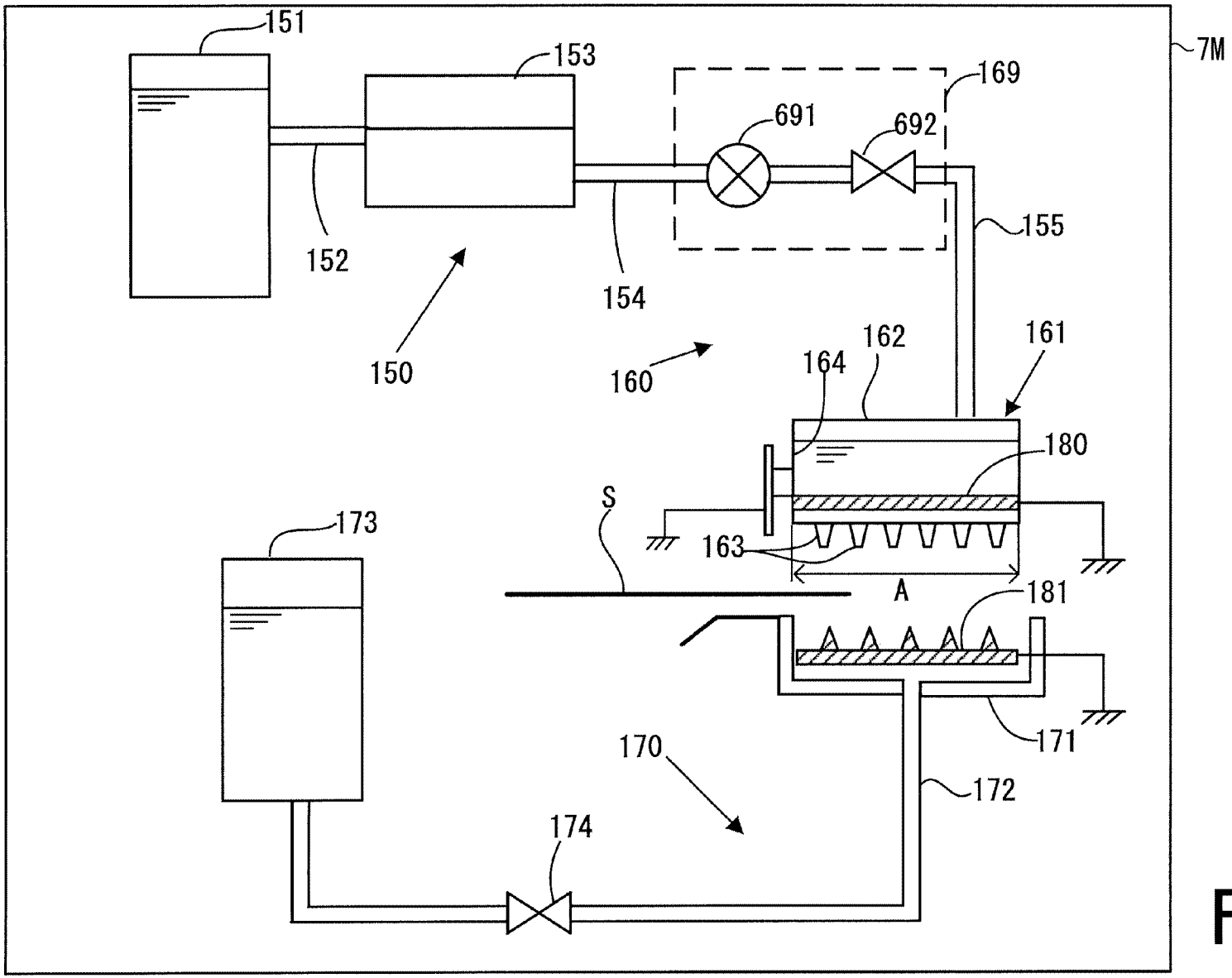
FIG. 8 schematically shows a configuration of a fixing device according to a third embodiment.

FIG. 8 schematically shows a configuration of a fixing device 7M according to the third embodiment. The fixing device 7M has a supply unit 150, a spraying unit 160, and a collection unit 170. The supply unit 150 is configured to supply a fixing liquid to a casing 162 (described below) of the spraying unit 160. The supply unit 150 is equipped with a supply tank 151, supply tubes 152, 154, 155, and a sub-tank 153. The supply tank 151 contains the fixing liquid therein. The supply tank 151 is detachably attached to the housing 2. The supply tank 151 and the sub-tank 153 are connected via a supply pipe 152. The supply tube 152 is connected to the supply tank 151 in a state where the supply tank 151 is attached to the housing 2 and allows passage of the fixing liquid stored in the supply tank 151. The sub-tank 153 accommodates the fixing liquid supplied from the supply tank 151 via the supply tube 152. The fixing liquid in the sub-tank 153 is supplied to the spraying unit 160 via the supply tubes 154 and 155.

The spraying unit 160 is configured to spray the fixing solution. The spraying unit 160 has a spraying head 161, a pressurizing section 169, a nozzle electrode 180, and an opposing electrode 181. The spraying head 161 has a casing 162 configured to accommodate the fixing solution and a plurality of nozzles 163. A containing space 164 is defined in the casing 162 where the fixing liquid is accommodated. The casing 162 accommodates the fixing liquid supplied, via the supply tube 155, from the supply tank 151. The plurality of nozzles 163 is configured to spray the fixing liquid accommodated in the casing 162 onto the sheet S. The plurality of nozzles 163 is provided on a lower side of the casing 162. A plurality of openings is formed on the lower wall of the casing 162 and communicates with a plurality of nozzle flow passages through which the fixing liquid flows in the nozzles 163. According to the above-described configuration, inside the spraying head 161, flow passages of the fixing liquid are formed from the containing space 164 to the nozzle passage of each nozzle 163.

The nozzle electrode 180 is arranged inside the containing space 164 of the casing 162. The nozzle electrode 180 is connected to the high voltage generating circuit 20, and a positive polarity voltage V1, which is the same polarity the toner transferred onto the sheet S has, is applied by the high voltage generating circuit 20. According to this configuration, the nozzle electrode 180 can positively charge the fixing solution in the containing space 164 of the casing 162. The opposing electrode 181 has a plurality of projections, each of which is arranged, in a collection tray 171 (described below) arranged at a position lower than the spraying head 161, to be separated from the vents of the plurality of nozzles 163 by a particular distance. The opposing electrode 181 is connected to the high voltage generating circuit 20, and a voltage V2 is applied to the opposing electrode 181 by the high voltage generating circuit 20 so that a potential difference is formed between the nozzle electrode 180 and the opposing electrode 181. According to the third embodiment, a negative voltage V2, which is of opposite polarity to the voltage V1, is applied to the opposing electrode 181 by the high voltage generation circuit 20.

The pressurizing section 169 is connected between the supply tube 154 and the supply tube 155, and is configured to apply pressure to the fixing liquid supplied to the spraying head 161. Concretely, the pressurizing section 169 has a pressurizing pump 691 that pressurizes the air in the casing 162 and a pressure reducing valve 692 that reduces the pressure in the casing 162.

The collection unit 170 is configured to collect the fixing liquid sprayed by the spraying unit 160. The collection unit 170 has a collection tray 171, a collection piping 172, and a collection tank 173. The collection tray 171 is arranged below the spraying head 161 and is configured to receive and accommodate the fixing liquid sprayed from the nozzles 163. One end of the collection piping 172 is communicated with the collection tray 171 and allows the passage of the fixing liquid received by the collection tray 171. The other end of the collection piping 172 is communicated with the collection tank 173. According to the above configuration, the fixing liquid in the collection tray 171 is collected in the collection tank 173 via the collection piping 172.

As the fixing solution, a solution in which the toner is dissolved in a solvent with a high permittivity can be used to dissolve the toner so that the fixing solution can be sprayed well by the spraying unit 160 and the toner can be fixed onto the sheet S well. Water can be used as a safe solvent with a high dielectric constant. Aliphatic monocarboxylic acid esters, aliphatic dicarboxylic acid esters, aliphatic tricarboxylic acid esters, aliphatic dicarboxylic acid dialkoxyalkyl esters, or carbonate esters can be used as solutes. These solutes above have the ability to soften the toner. Surfactants may also be added to form a good emulsion, and anionic, cationic, or nonionic surfactants can be used as surfactants.

In the fixing device 7M according to the above configuration, an electric field associated with the potential difference is formed between the nozzle electrode 180 and the opposing electrode 181 of the spraying unit 160. The pressure Pf applied by the pressurized section 169 pushes the fixing liquid out of the vents of the nozzles 163. The fixing liquid pushed out of the vents of the nozzles 163 is sprayed from the vents of the nozzles 163 toward the opposing electrode 181 by the electric field. Therefore, as the sheet S passes underneath the spraying unit 160, the fixing solution is sprayed onto the surface on which the toner image is formed on the sheet S. According to the above procedure, steps S11, S12, and S18 according to the first embodiment (FIG. 4) can be omitted.

In the third embodiment described above, the printer 1 is equipped with the fixing device 7M that fixes the toner image onto the sheet S by spraying the fixing solution onto the sheet S to which the toner image has been transferred. That is, according to the third embodiment, the time required for printing can be reduced even in a configuration where the printer 1 uses the fixing device 7M that does not require heating.

Other Embodiments

It is noted that the above-described embodiments and modification can further be modified in various ways without departing from aspects of the present disclosures.

Instead of rotating the photoconductor 41, and the feed rollers 32 and 36 by one main motor 60, the photoconductor 41, and the feed rollers 32 and 36 may be rotated by separate motors. In such a case, in S10 of FIG. 4, the rotation of each of the above-mentioned motors needs only to be started. When the printer 1 is not equipped with the second and third clutches 64 and 65, the motor to rotate the first feed roller 32 may be driven in S17.

The image forming apparatus may not be limited to a printer, but may be, for example, an MFP equipped with a function of the printer, and a function of a scanner or a facsimile machine. The printer may be a printer configured to form a toner image having multiple colors on a sheet.

It is noted that the controller does not need to be limited to a single piece of hardware with a single CPU. The controller may be a combination of multiple CPUs and multiple pieces of hardware such as an ASIC to realize the functions of the controller.

What is claimed is:

1. An image forming apparatus, comprising:

a photoconductor;

an exposure device including a polygon mirror configured to deflect a light beam to expose the photoconductor;

a developing device configured to supply a toner to the photoconductor exposed by the light beam deflected by the polygon mirror;

a transfer device configured to transfer the toner on the photoconductor onto a sheet;

a sheet tray configured to accommodate multiple sheets;

a feed roller configured to feed the sheets accommodated in the sheet tray; and a controller, wherein the controller is configured to:

determine, when printing is started, whether a particular condition is satisfied, the particular condition being satisfied when an elapsed time from a time when the polygon mirror starts rotating to a time when a rotation speed of the polygon mirror has reached a determination speed which is slower than a target speed is less than an upper limit time;

when the particular condition is determined to be satisfied, feed the sheet from the sheet tray with the feed roller before the rotation speed reaches the target speed; and when the particular condition is determined not to be satisfied, feed the sheet from the sheet tray with the feed roller after the rotation speed has reached the target speed.

2. The image forming apparatus according to claim 1, wherein the controller is configured to determine, when the printing is started, that the particular condition is satisfied when the elapsed time from the time when the polygon mirror starts rotating to the time when the rotation speed of the polygon mirror has reached the determination speed is less than the upper limit time and equal to or greater than a lower limit time which is shorter than the upper limit time.

3. The image forming apparatus according to claim 1, wherein, when the controller determines that the particular condition is not satisfied, the controller is configured to feed the sheet from the sheet tray with the feed roller after the rotation speed is converged within a particular speed range including the target speed.

4. The image forming apparatus according to claim 1, wherein the exposure device includes a motor configured to rotate the photoconductor, and wherein, when the printing is started, the controller is configured to rotate the polygon mirror after rotating the motor.

5. The image forming apparatus according to claim 4, further comprising:

a motor configured to rotate the feed roller; and a switching mechanism configured to switch a state of power transmission from the motor to the feed roller between a transmission state and a blocked state, wherein the controller is configured to:

when the printing is started, start rotating the motor with setting, with the switching mechanism, the state of the power transmission from the motor to the feed roller to the blocked state; and at a timing when it is determined thereafter that the particular condition is satisfied, set the state of the power transmission from the motor to the feed roller to the transmission state with the switching mechanism.

6. The image forming apparatus according to claim 1, wherein the sheet tray includes a first tray and a second tray, wherein the feed roller includes a first feed roller to feed the sheet on the first tray and a second feed roller to feed the sheet on the second tray, wherein a distance from the first feed roller to the transfer device is a first length, wherein a distance from the second feed roller to the transfer device is a second length, the second length being longer than the first length, and wherein the controller is configured to determine whether the particular condition is satisfied on condition that the sheet is fed out from the second tray.

7. The image forming apparatus according to claim 1, further comprising a fixing device configured to heat-fix the toner by heating the sheet on which the toner has been transferred, wherein the controller is configured to determine, when the printing is started, whether the particular condition is satisfied on condition that a temperature of the fixing device is equal to or larger than a particular temperature.

8. The image forming apparatus according to claim 1, further comprising a fixing device configured to heat-fix the toner by heating the sheet on which the developing device has been transferred, wherein, when determining that the particular condition is satisfied, the controller is configured to start energizing the fixing device after feeding out the sheet with the feed roller.

9. The image forming apparatus according to claim 1, further comprising a fixing device configured to fix the toner by spraying a fixing solution onto the sheet on which the toner has been transferred.

10. A method of controlling an image forming apparatus equipped with a photoconductor, an exposure device including a polygon mirror configured to deflect a light beam to expose the photoconductor, a developing device configured to supply a toner to the photoconductor exposed by the light beam deflected by the polygon mirror, a transfer device configured to transfer the toner on the photoconductor onto a sheet, and a sheet tray configured to accommodate multiple sheets, wherein the method comprises:

when printing is started and when an elapsed time from a time when the polygon mirror starts rotating to a time when a rotation speed of the polygon mirror has reached a determination speed which is slower than a target speed is less than a first time, feeding the sheet from the sheet tray before the rotation speed reaches the target speed; and when the elapsed time is equal to or greater than the first time, feeding the sheet from the sheet tray after the rotation speed has reached the target speed.

11. An image forming apparatus, comprising:

a photoconductor;

an exposure device including a polygon mirror configured to deflect a light beam to expose the photoconductor;

a developing device configured to supply a toner to the photoconductor exposed by the light beam deflected by the polygon mirror;

a transfer device configured to transfer the toner on the photoconductor onto a sheet;

a sheet tray configured to accommodate multiple sheets;

a feed roller configured to feed the sheets accommodated in the sheet tray; and a controller, wherein, when start printing, the controller is configured to:

start rotating the polygon mirror;

when a rotation speed of the polygon mirror reaches a determination speed, that is slower than a target speed, within an upper limit time after the polygon mirror starts rotating, start feeding the sheet from the sheet tray with the feed roller before the rotation speed reaches the target speed; and when the rotation speed does not reach the determination speed within the upper limit time after the polygon mirror starts rotating, start feeding the sheet from the sheet tray with the feed roller after the rotation speed reaches the target speed.

* * * * *